United States Patent [19]

Juranitch

[11] Patent Number: 4,934,110

[45] Date of Patent: Jun. 19, 1990

[54] EDGE SHARPENING APPARATUS

[76] Inventor: John Juranitch, Rte. 1, Box 2006, Ely, Minn. 55731

[21] Appl. No.: 931,701

[22] Filed: Nov. 17, 1986

Related U.S. Application Data

[63] Continuation-in-part of Ser. No. 726,085, Apr. 22, 1985, abandoned.

[51] Int. Cl.[5] ..... B24B 3/54

[52] U.S. Cl. ..... 51/354; 51/214; 51/212; 76/82; 76/86; 76/88

[58] Field of Search ..... 51/214, 204, 205 WG, 51/211, 212, 354; 76/82, 82.2, 86, 88

[56] References Cited

U.S. PATENT DOCUMENTS

| | | | |
|---|---|---|---|
| 578,440 | 3/1897 | Beaudin | 51/285 |
| 1,041,631 | 10/1912 | Johnson | 51/354 |
| 1,570,083 | 1/1926 | Runzi | 51/211 R |
| 1,851,520 | 3/1932 | Moller | 51/211 R |
| 1,909,743 | 5/1933 | Blankner | 51/354 |
| 2,124,646 | 7/1938 | Barsch | 51/214 |
| 4,550,632 | 11/1985 | Inman | 76/86 |

FOREIGN PATENT DOCUMENTS

| | | | |
|---|---|---|---|
| 0190414 | 7/1956 | Fed. Rep. of Germany | 51/205 R |
| 0293785 | 3/1928 | United Kingdom | 51/214 |
| 0517242 | 1/1940 | United Kingdom | 51/354 |

*Primary Examiner*—Robert Rose

*Attorney, Agent, or Firm*—Dority & Manning

[57] ABSTRACT

A device for sharpening a cutting edge including a base an elongated slot that is dimensioned to permit free passage of a cutting blade therealong. At least one sharpening element is pivotally secured to the base near its upper end and extends across the slot at a predetermined angle. Preferably, two such sharpening elements are employed, intersecting at the slot so that a cutting edge moved along the slot will be sharpened on both sides during a single pass through the slot. The sharpening elements may be straight or curved and are always under a predetermined tension. This tension may be applied by either springs or counterweights.

18 Claims, 6 Drawing Sheets

EDGE SHARPENING APPARATUS

RELATED APPLICATION

This application is a continuation-in-part of my U.S. application Ser. No. 726,085,51-214 filed Apr. 22, 1985 now abandoned.

BACKGROUND OF THE INVENTION

The present invention relates to an apparatus for applying a proper cutting edge on an elongated cutting tool.

Whether for domestic or industrial use, it is important that a cutting tool such as a knife maintain an appropriate cutting edge for best performance of its intended function, i.e. to be used to sever a particular item. Historically, the cutting element whether a rotary blade, an elongated blade, a knife or the like has been manufactured of steel, and during initial manufacture the steel has been appropriately ground to produce a single or double bevel cutting edge along peripheral portions of same. While the grinding operation imparts the appropriate bevel to the cutting edge, for most operations it is necessary to supplement the sharpening of the edge by bringing the edge into appropriate angular contact with a sharpening stone, steel or the like. In fact, preparation of a truly correct and appropriate cutting edge, requires that an appropriate angular relationship be maintained between the cutting element and the sharpening stone, steel or the like, as well as appropriate pressure of the cutting edge on the sharpening element.

In home or domestic use of a cutting tool, while it is always desirable to maintain an appropriately sharpened edge, the absence of a truly correct cutting edge is generally the case, but is not totally detrimental to use of the tool. Short term and/or infrequent use of the tool by a housewife, for example, negates any serious concerns. In fact, once a cutting tool is purchased with an initially sharpened edge for domestic use, it is generally acceptable to thereafter run the cutting edge over a hand-held sharpening steel to maintain a sharpened edge. Such technique is likewise generally acceptable in commercial establishments where again the cutting tool is used only intermittently, or on an infrequent basis.

In an industrial environ, however, such as the meat packing industry, where the cutting tool, primarily a knife, is used constantly, truly correct and appropriately sharpened cutting edges become particularly important. Not only does an appropriate cut of the meat result from use of a proper cutting edge, but also fatigue of one using the tool is of paramount importance. For example, an individual cutting meat in an abbatoir or packing house during an eight-hour shift with a cutting tool that is not properly sharpened, loses production due to the cutting edge, and is subject to becoming very fatigued. On the other hand, the same individual utilizing a cutting tool with a truly proper cutting edge experiences increased production with much less tiredness or fatigue. It is therefore important to have an apparatus available for maintaining a truly correct edge on a cutting tool during day-to-day use, not only in industry, but also for general domestic and other use.

Devices have been provided heretofore for the sharpening or steeling of a cutting edge. Such prior devices have included mechanized sharpening apparatus where the cutting tool is mounted on a machine and the particular sharpening surface brought into rotary or other contact therewith. Static structures have also been provided with one manually bringing the cutting edge into moving angular contact with a steel or the like. One such steeling apparatus is represented by a flat base to which a pair of elongated, cylindrical elements are secured in a "V" relationship. One seeking to sharpen a cutting edge of a tool may simply move the cutting edge across the appropriate steel. While a device of this type may, under appropriate circumstances successfully yield a correct cutting edge on the tool, open space between the two steels oriented in the "V" leaves room for massive error in angular relationship other than exactly at the apex of the "V", and then only so long as the cutting edge is drawn across the steels at a proper relationship with respect to the "V". Also, no consideration is made as to the pressure of the cutting tool against the steel.

The present invention is directed to a device that alleviates the need for mechanization while at the same time ensures that, a proper angular relationship and pressure are maintained between the cutting edge and the steel throughout the stroke. There is no known prior art that is believed to teach or suggest the steeling apparatus of the present invention.

SUMMARY OF THE INVENTION

It is an object of the present invention to provide an improved device for sharpening an elongated cutting tool.

Another object of the present invention is to provide an improved device for sharpening an elongated cutting tool that permits the entire length of the cutting tool to be sharpened while retaining an appropriate predetermined angular relationship between the cutting tool and the sharpening elements.

Another object of the present invention is to provide a device for sharpening the elongated cutting edge of a cutting tool in which the sharpening elements offer only a predetermined resistance to pressure applied to them by the cutting edge during the sharpening operation.

Yet another object of the present invention is to provide an apparatus for the appropriate sharpening of a hand-held cutting tool to achieve a precise and appropriate cutting edge thereon.

Generally speaking, the sharpening apparatus according to the present invention comprises a base, said base defining an elongated slot therealong through which a cutting edge to be sharpened may pass while retaining the cutting edge generally axial to an axis extending longitudinally along the slot; and a sharpening element secured to said base and extending across said elongated slot at a predetermined angle with respect to said slot so that a cutting tool passing through said slot will engage said sharpening element at a predetermined angle.

When apparatus according to the present invention includes a single sharpening element, a cutting tool having a conventional double bevel cutting edge is passed through the device twice, from opposite sides. In a preferred arrangement, however, two sharpening or steeling elements are provided, extending across the slot from opposite directions and preferably at opposite angles. As such, a cutting tool will be sharpened on both sides of the cutting edge during a single pass.

In one embodiment of the invention, the sharpening elements are spring loaded to cause them to extend across the slot and across each other at the point where they cross the slot. In another embodiment, each of the cutting elements is equipped with a counterweight on its opposite end which causes the steeling elements to extend across the slot and across each other at the point they cross the slot.

In some of the embodiments, the steeling elements are straight and in others, the steeling elements are curved in the portion that extends across the slot. In this embodiment, the curvature of the sharpening elements is such that they intersect each other at the point they cross the elongated slot at a predetermined angle so that a cutting tool passing through the slot will engage the sharpening elements at a predetermined angle on each side of the cutting edge, all along the length of the elongated slot. As such, a cutting tool will be sharpened on both sides of its cutting edge during a single pass through the elongated slot.

In another embodiment of the invention, the steeling elements are fixed to each side of the slot, that is one is located on each side of the slot, with the steeling elements coming into abutting contact at the lower portion of the slot. This embodiment is adapted to contact the beveled portion of the cutting tool only. This embodiment may be mounted on a separate base or on the reverse side of the base from those embodiments having pivoted steeling elements.

Steeling or sharpening elements employed in the present invention are suitably manufactured from any hardened material that will produce an appropriate cutting edge on the cutting tool, and though preferably presenting a smooth surface, an abrasive surface may also be employed. Curved steeling elements are used in the invention and due to the angle of curvature of the elements, they may pivot about points along the length of the slot to present a generally angular relationship along the entire length of the slot. Hence, depending upon the criticality of the angular relationship for the particular cutting tool, each of the steeling elements will be curved so as to provide the desired angle at the point the steeling elements cross the elongated slot. Also, since it is likely that some contact may be made between the base and the cutting elements, the base is preferably manufactured of a material that will not adversely affect the cutting edge when contacted thereby.

The desired angular relationship between the cutting edge to be sharpened and the steels during sharpening will vary depending upon the intended use of the cutting tool. In general, the cutting edge is preferably maintained at an angle of from about 20° to about 40° with respect to the sharpening element, and preferably about 35°. The counterweights or springs on the opposite ends of the sharpening elements causes the element to pivot across the elongated slot and accomplishes a plurality of purposes. The pivotal movement of the elements across the slot will maintain a generally acceptable range of angles for edge/element contact. Likewise, movement of the elements along the slot presents greater areas of the elements for operative contact with the elongated edge and thus extends the effective life of the sharpening elements. Also, during truly proper steeling, a predetermined amount of edge pressure against the curved sharpening elements is preferred.

The counterweights or springs used in conjunction with the elements can thus be preselected to offer a predetermined amount of resistance to the cutting edge before said elements pivot about their pivot points. The steeling elements according to the present invention may be straight or curved, and preferably present an inside curved area to the cutting edge to be sharpened, however, an outside curved area can also be used in some instances. The counterweights or springs on the steel elements permit pivotal movement of the steel elements during the sharpening operation and achieves two primary results. First, a greater length of the steel element is contacted by the cutting edge, thereby prolonging the useful life of the steel element. Secondly, in the preferred sharpening operation, only a predetermined resistance to pressure brought by the cutting edge should be applied to the steel elements. Hence, preselection of the counterweights or springs permit precise control of the resistance offered by the steel elements when the elongated cutting edge is passed downwardly and through the elongated slot.

The base for the sharpening apparatus according to the present invention, is a single piece, and the steeling elements are pivotally secured to the base on opposite sides of an elongated slot therein. The counterweight or spring on each of said sharpening elements causes the element to pivot and to cross the elongated slot and to intersect with the opposite sharpening element whereby a "V"-shaped notch is produced at the intersection of the steeling elements in the longitudinal slot.

BRIEF DESCRIPTION OF THE DRAWINGS

The construction designed to carry out the invention will be hereinafter described, together with other features thereof.

The invention will be more readily understood from a reading of the following specification and reference to the accompanying drawings forming a part thereof, wherein an example of the invention is shown, and wherein.

DETAILED DESCRIPTION OF PREFERRED EMBODIMENTS

Making reference to the figures, preferred embodiments of the present invention will now be described in detail.

Figure 1:
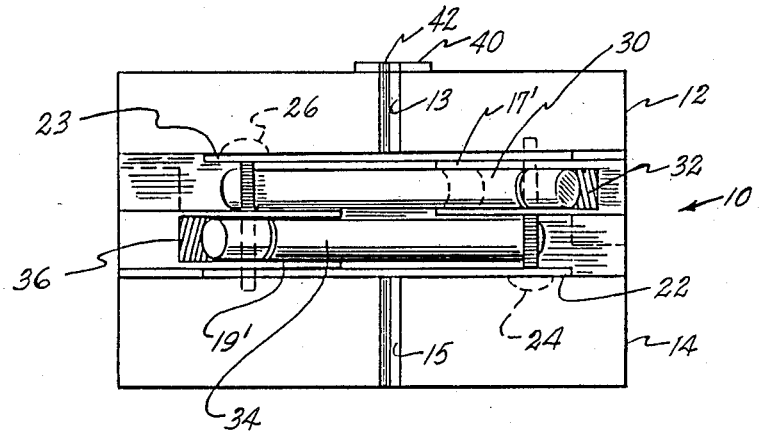
FIG. 1 is a top plan view of a sharpening device for a cutting edge according to teachings of the present invention.
Figure 2:
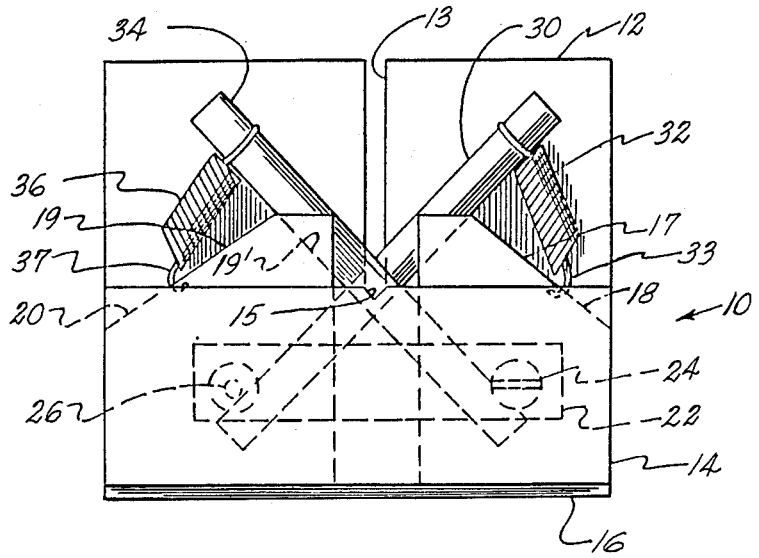
FIG. 2 is a side elevational view of the sharpening device as illustrated in FIG. 1.
Figure 3:
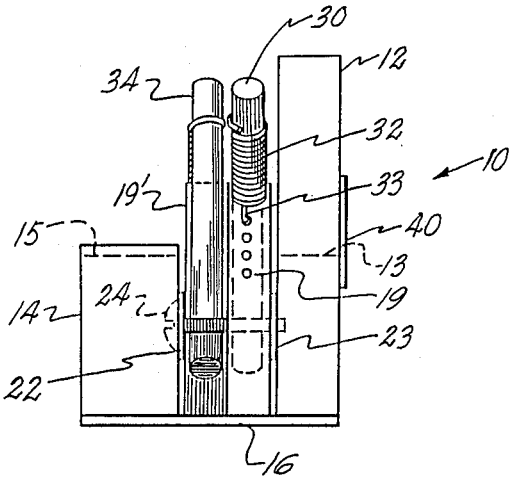
FIG. 3 is an end elevational view of the device as illustrated in FIGS. 1 and 2.

In FIGS. 1 through 3, a sharpening device generally indicated as 10 is provided having a base that is made up of a rear wall 12, a forward wall 14 spaced apart therefrom and a bottom plate 16 to which walls 12, 14 are secured. Rear and front walls 12 and 14 define elongated slots 13, 15, respectively therein with rear slot 13 being significantly longer than front slot 15. A first sharpening or steeling element support 17 is provided intermediate front and rear walls 12 and 14 and defines a cut-away ledge 17' for receipt of a portion of a sharpening element 30 as will be described hereinafter. A second steeling element support 19 is located between front and rear walls 12 and 14, respectively, on an opposite side of slots 13 and 15 to first element support 17. Support 19 defines a ledge 19' for receipt of a portion of second sharpening element 34 likewise as will be described hereinafter. As can be seen from the figures, the supports 17 and 19 for elements 30 and 34 are offset with respect to each other such that one steeling element does not interfere with movement of the other steeling element.

Sharpening elements or rods 30, 34 reside atop support ledges 17', 19', respectively, and extend across a plane through slots 13, 15 at an angle defined by beveled ledges 17', 19'. An upper end of steeling elements 30, 34 receive a portion of a coil spring 32, 36, respectively, while an opposite end of springs 32, 36 are received in one of a plurality of spring receiving openings, 18, 29 on supports 17, 19, respectively, and thus apply spring tension to an upper portion of elements 30, 34. A lower free end of steeling elements 30, 34 reside beneath bolts 24, 26, respectively. Bolts 24, 26 pass through supports 17, 19 are secured in place. An exposed portion of bolt 24 serves as an upward stop for the element 34 received thereunder while a similar portion of bolt 26 serves as a stop for element 30.

With a sharpening device as described above, and with one or two steeling elements associated therewith, a cutting edge is drawn through slots 13, 15 against the surface of elements 30 and 34, whereby opposite sides of the cutting edge will make engagement with the adjacent steeling element at a predetermined angular relationship determined by the slope of ledges 17', 19'. When adequate pressure is applied by the cutting edge against the steeling elements, the force of springs 32, 36 will be overcome and steeling elements 30, 34 will pivot downwardly about ledges 17', 19', respectively. Additionally, as is specifically shown in FIGS. 1 and 3, a guard 40 may be secured to device 10 outwardly of slot 13. A cutting tool being sharpened would also pass through guard 40, and specifically through a slot 42 therein where any extraneous materials from a surface of the cutting tool are removed prior to sharpening. Foaling of the sharpening elements may then be minimized by fat meat or the like.

Figure 4:
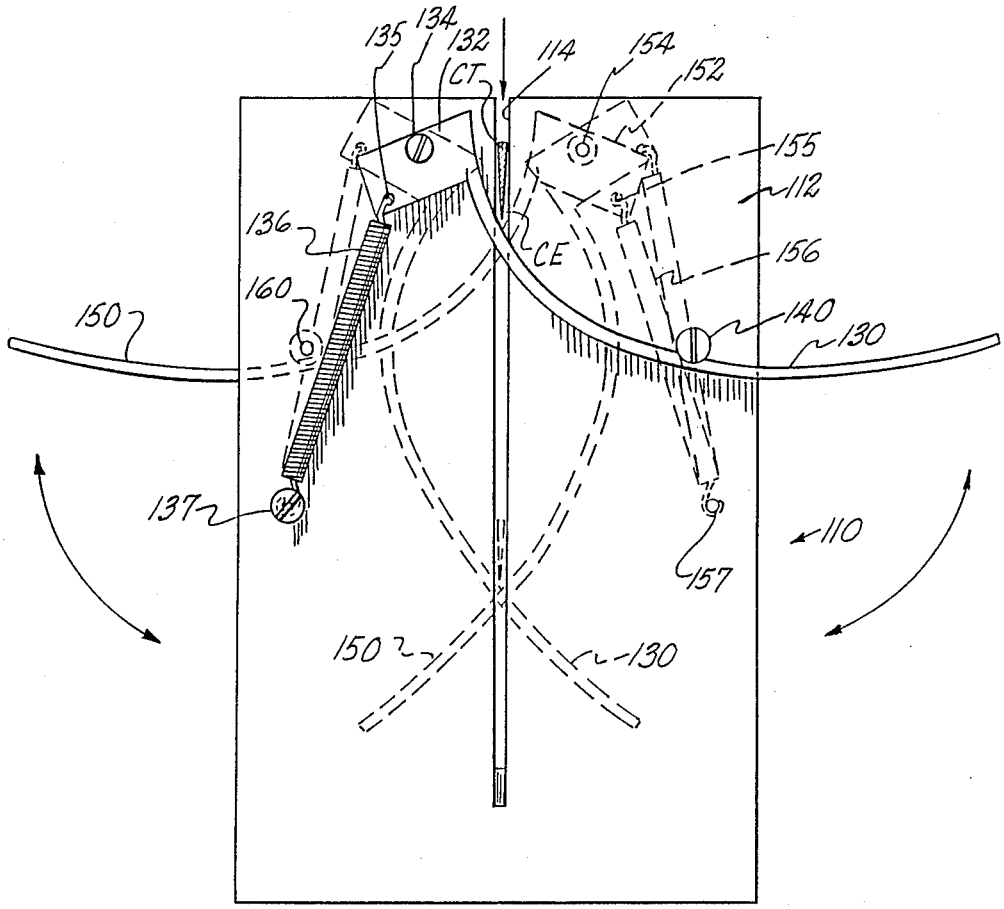
FIG. 4 is a side elevational view of a further embodiment of a sharpening device according to teachings of the present invention.

FIG. 4 illustrates a further, and a preferred embodiment of the present invention generally indicated as 110, wherein a unitary base 112 is provided that defines an elongated slot 114 therein. A first steeling element 130 has a plate 132 at one end of same which is pivotally secured to base 112 by a connector element 134. An outer end of plate 132 defines an opening 135 in which is received a portion of a spring means 136. Spring means 136 is secured at an opposite end to a connector element 137, secured to base 112 to apply a predetermined amount of spring tension to element 130. Sharpening or steeling element 130 is curved, and when under spring tension is biased upwardly with respect to slot 114 and engages a stop 130 secured to base 112. In the broadest sense of the present invention, in which a single sharpening element is utilized, only element 130 and the above described appurtances would be necessary to apply a proper cutting edge CE on a cutting tool, CT is illustrated in cross-section in slot 114. When only one sharpening element is employed, both sides of cutting edge CE would be appropriately sharpened, but during separate passes of the cutting tool through slot 114 from opposite directions. As illustrated in FIG. 4, however, and as preferred, a second sharpening element 150 and plate 152 are pivotaly secured to base 112 by a connector element 154 on an opposite side of base 112 to first element 130. Similar to element 130, element 150 is also curved with an opposite end of plate 152 receiving a spring means 156 that is secured at one end within an opening 155 defined in plate 152 and at an opposite end to a connector element 157.

With the arrangement as is illustrated in FIG. 4, where two sharpening or steeling elements 130, 150 are employed on opposite sides of base 112, a cutting tool CT is drawn through slot 114 in a downward motion, bringing cutting edge CE into engagement with a portion of elements 130 and 150. As the force of cutting edge CE on the elements 130, 150 increases, springs 136, 156 will be overcome and elements 130 and 150 will pivot downwardly about their respective points of securement to base 112 towards a lower position indicated in phantom in FIG. 4. As can further be seen from FIG. 4, steeling elements 130 and 150 cross slot 114 from opposite directions whereby a particular angular relationship is established therebetween. Note that in the lower or pivoted position steeling elements 130 and 150 present a generally same angular relationship. Hence, a generally same angular relationship may be maintained between cutting edge CE and elements 130 and 150 all along slot 114. In this fashion, the attributes of the present invention are realized as set forth hereinabove. Namely, the same general range of angular relationship is retained along the length of slot 114, different portions of steeling elements 130, 150 are engaged by the cutting element to prolong the life of same, and the predetermined amount of force only applied to steeling elements 130, 150 by cutting edge CE is maintained.

Figure 5:
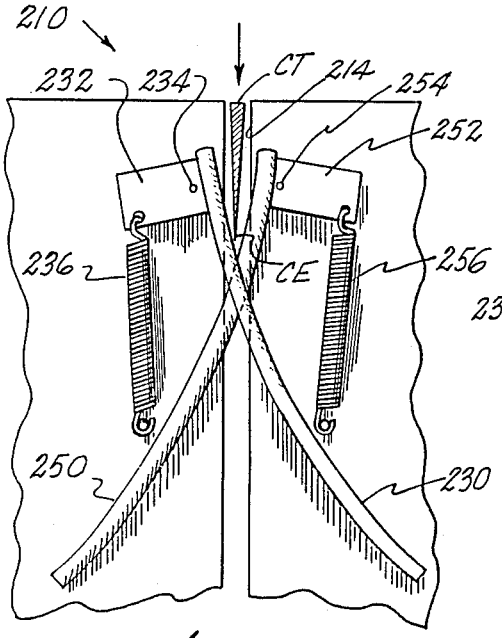
FIGS. 5 and 6 are partial side elevational views of a further embodiment of the type device illustrated in FIG. 4, showing in more detail the relationship between a cutting edge being sharpened thereby and sharpening elements.
Figure 6:
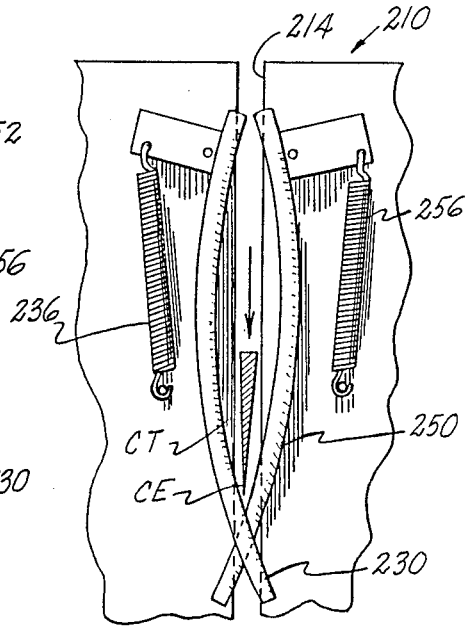

A similar embodiment to that shown in FIG. 4 is illustrated in FIGS. 5 and 6. In both FIGS. 5 and 6, it is noted that both steeling elements 230, 250 are located on the same side of a base 212. Elements 230, 250 are curved, pivotally secured to base 212 at points 234, 254, respectively, and have spring means 236, 256 secured thereto in like fashion as described with respect to FIG. 4 for maintenance fo spring tension. FIG. 5 specifically illustrates a cutting tool CT entering the sharpening slot 214 where the desired angular relationship is established between cutting edge CE thereof and an inside surface of steeling elements 230, 250. In FIG. 6, the pressure of cutting edge CE against steeling elements 230, 250 has overcome the force of springs 236, 256 and steeling elements 230, 250 have pivoted downwardly in front of cutting tool CT to again realize the benefits of the device of the present invention as enumerated above.

Figure 7:
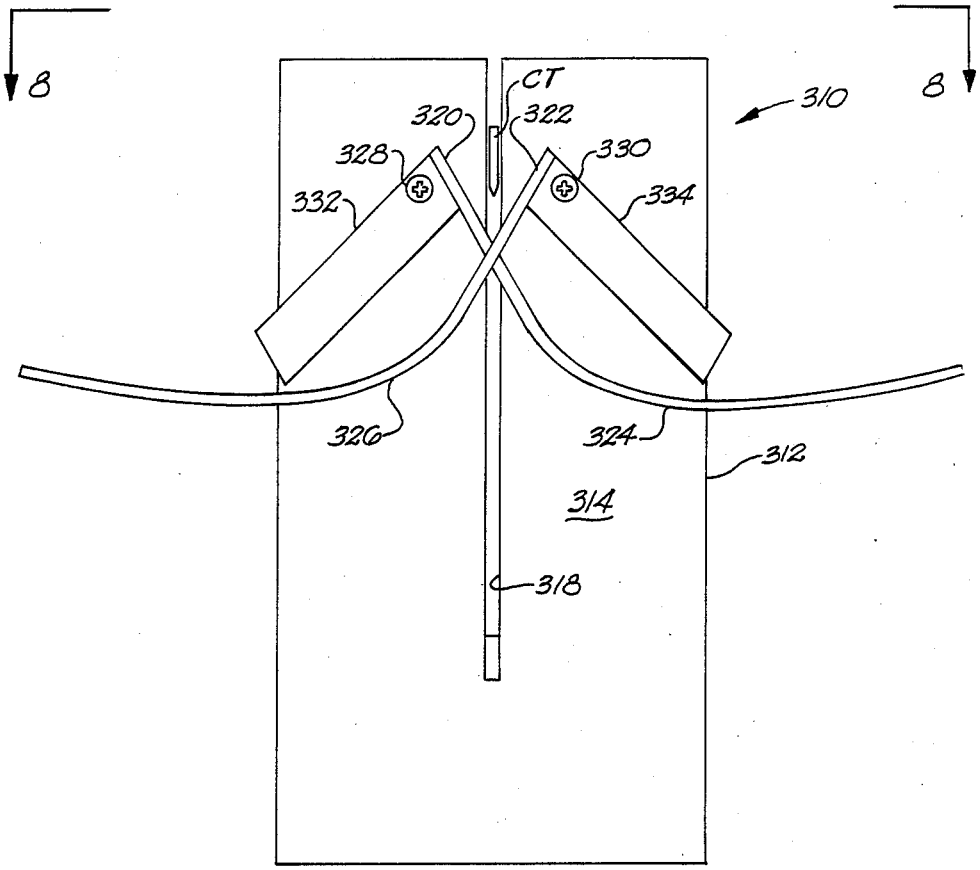
FIG. 7 is a front elevational view of another embodiment of the sharpening device according to the teachings of the present invention.
Figure 8:
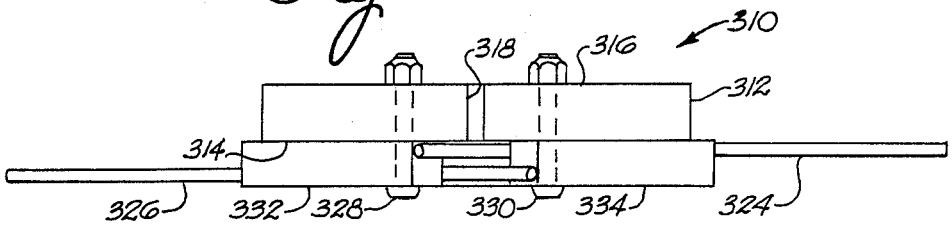
FIG. 8 is a top plan view of the sharpening device illustrated in FIG. 7 taken generally along lines 8—8 of FIG. 7.

In FIGS. 7 and 8, a sharpening device generally indicated by the reference character 310 is provided having a base 312. Base 312 has front surface 314 and rear surface 316. In the middle of base 312 is a elongated slot 318 which extends through base 312 for substantially the entire length of the base. Slot 318 is provided for guiding the cutting tool to be sharpened by the sharpening apparatus or device.

Adjacent the upper end of elongated slot 318 is a pair of steel sharpening elements 324 and 326. Sharpening elements 324 and 326 are pivotally supported on base 312 by pivots 328 and 330. Integral with sharpening element 324 is a counterweight 332 and sharpening element 324 is welded to the end of counterweight 332. Pivot point 328 extends through the upper end of counterweight 332 adjacent to one side of elongated slot 318. Cutting element 324 and its counterweight are free to pivot about pivot point 328 so that when unrestrained, the curved steel element 324 extends across elongated slot 318.

On the opposite side of slot 318 also at the upper end of substantially equal height with sharpening element 324, is a second sharpening element 326 which is welded to a counterweight 334. Counter-weight 334 and its sharpening element 326 are pivotally mounted on base 312 by means of pivot 330 which extends through base 312.

Referring now more particularly to FIG. 8 wherein it will be noted that sharpening element 324 is connected to counterweight 332 and lies adjacent to the face 314 of the base 312. On the other hand, sharpening element 326 is welded to counterweight 334 along its outer edge so that sharpening element 326 may freely pivot without interference from sharpening element 324. On the other hand, as seen in FIG. 7, counterweights 332 and 334 engage the steel element of each other so as to limit the downward movement of counterweights 332 and 334, respectively. It will also be noted that in the embodiment of FIGS. 7 and 8, sharpening elements 324 and 326 are curved in the opposite directions when mounted on base 312 so as to extend across the elongated slot 318 with the inside curved surfaces providing a V-shaped notch at the point where elements 324 and 326 intersect with each other and with the elongated slot 318. Elements 324 and 326 are curved so as to provide the same angle of contact between the cutting edge and the sharpening elements throughout the length of the elongated slot 318. Thus, as cutting tool 336 is drawn through and downward of slot 318, the angle of contact between sharpening elements 324 and 326 with the cutting edge of tool CT remains the same throughout. Counterweights 332 and 334 are carefully selected so as to provide the optimum resistance in opposition to the pivoting motion of sharpening elements 324 and 326 in response to contact with the cutting tool CT, thus providing a uniform and limited pressure between the cutting edge of tool CT and the sharpening elements 324 and 326 which remain substantially constant throughout the passage of tool 336 through slot 318.

Figure 9:
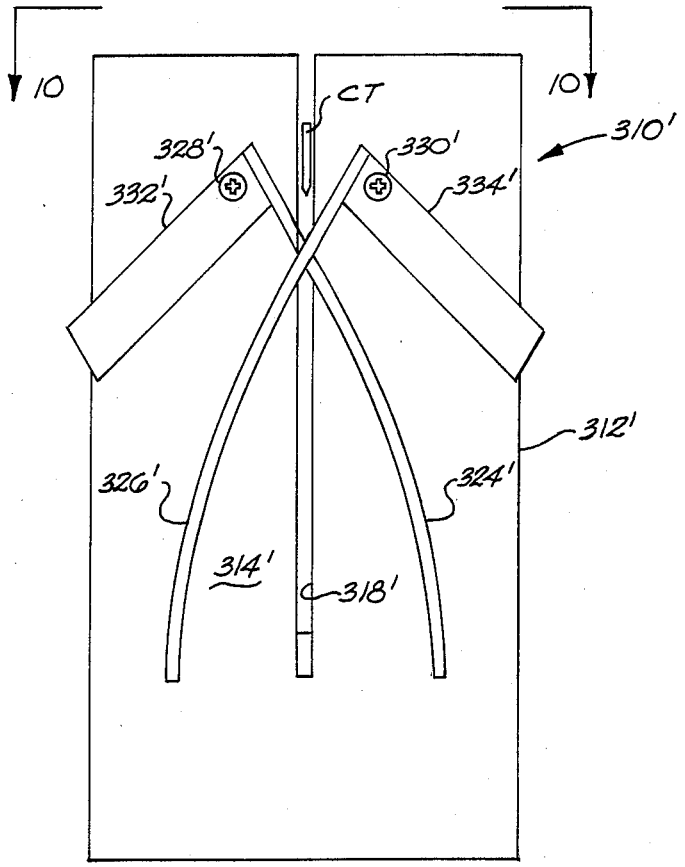
FIG. 9 is a front elevational view of another embodiment of the sharpening device for sharpening a cutting edge according to the teachings of the present invention.
Figure 10:
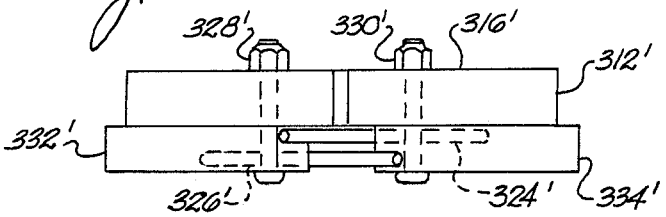
FIG. 10 is a top plan view of the sharpening device illustrated in FIG. 9 taken generally along lines 4—4 of FIG. 9.

FIGS. 9 and 10 illustrate a further embodiment of the present invention which is substantially identical to the embodiment of FIGS. 7 and 8 except for the curvature of sharpening elements 324' and 326'. In this embodiment, sharpening elements 324' and 326' are welded to counterweights 332' and 334', respectively, and the combined counterweight and sharpening elements are pivotally supported on the base 312 by means of pivot points 328' and 330'. Sharpening elements 324' and 326' extend across an elongated slot 318' which is provided for guiding the cutting tool during the sharpening operation. Sharpening elements 324' and 326' curve downwardly in opposite directions so as to present a V-shaped notch to the cutting edge of cutting tool 336' at the point sharpening elements 324' and 326' intersect each other. The curvature of sharpening elements 324' and 326' is such that the angle of contact between each of the sharpening elements and the cutting edge remains the same throughout the length of slot 318'.

In this embodiment as in the embodiment of FIGS. 7 and 8, sharpening element 324' is carried by its counterweight adjacent to surface 314' and sharpening element 326' is welded to the outer edge of counterweight 334' to provide clearance between the curved sharpening elements so that said elements may pivot freely.

Counterweights 332' and 334' are carefully selected so as to provide a uniform resistance to the pivoting of sharpening elements 324' and 326' so that a uniform pressure between cutting tool CT and the sharpening elements will be applied throughout the length of slot 18'.

Figure 11:
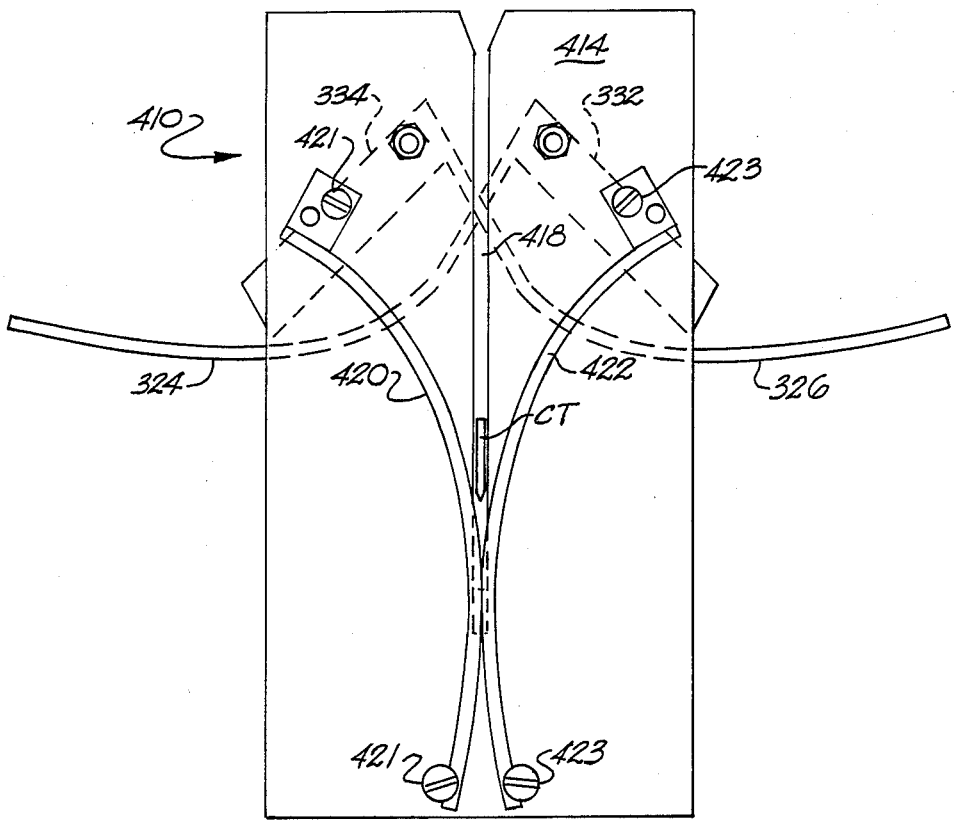
FIG. 11 is a front elevational view of yet another embodiment of the sharpening device of the invention for sharpening the bevel of a cutting tool without contacting the cutting edge itself.

Referring now to FIG. 11, wherein another embodiment of the invention is illustrated, the sharpening device 410 comprises a base 412 having a front surface 414 and an elongated slot 418. Disposed on either side of slot 418 are curved steeling elements 420 and 422. Element 420 is held firmly in place by screw means 421 at either of its ends on one side of the slot with a portion of its curved surface overlapping the slot. Steeling element 422 is disposed on the opposite side of the base, and is fixed in position by means of screws 423 at either end of the steeling element. Steeling element 422 is curved so as to overlap a portion of the elongated slot and to come into abutting contact with steeling element 420. The curvature of sharpening elements 420 and 422 is such that they contact the beveled sides of the blade of the cutting tool CT without contacting the cutting edge itself. This embodiment may be mounted on a separate base or it may be mounted on the reverse side of the bases in the embodiments having the pivoted steeling elements. Where they are mounted on the reverse side of the embodiment with the pivoted steeling elements, the bevel may be reduced at the same time the edge is sharpened by the pivoted steeling elements.

With each of the embodiments of the sharpening devices of the present invention illustrated in the drawings, it may be seen that the slot through the respective bases are sufficiently wide to permit the blade of the cutting tool to pass freely therethrough. However, the slot is narrow enough to prevent the blade of the cutting tool from deviating greatly from the attitude axial to a center line taken through the slot, so that along the length of the slot a proper angular relationship will be retained between the cutting edge and the steeling or sharpening elements. The strength of the springs or the weight of the counterweights in each of the embodiments of the invention are carefully selected so as to apply a predetermined amount of resistance to the steeling elements to prevent their pivoting downwardly as the cutting edge passes through the slot so as to apply a uniform resistance to the passage of the cutting edge. It should be pointed out, that the springs or the counterweights may be selected so that the steeling elements may be readily pivoted upon receipt of very light pressure from the cutting edge to the point where the springs are so strong or the weights are so heavy as to make the steel elements substantially immovable so as to require a great amount of pressure to pivot the steeling elements as the cutting edge passes through the elongated slot.

Insofar as the sharpening or steeling elements themselves are concerned, any hard, metallic material may be utilized that will not be cut or scarred by the cutting edge to be sharpened. Though a smooth surface element is preferred, an abrasive element may likewise be employed for the sharpening operation. The base structure to which the sharpening elements are secured may be constructed as desired so long as the sharpening operation described herein may be properly conducted. In that regard, to avoid damage to the cutting edge being sharpened, at least a portion of the base that surrounds the slot through which the cutting tool is passed, should be of a material that will not damage the cutting edge. Polymeric material such as polyethylene have been found to be appropriate.

Further, while in many instances the sharpening device according to the present invention may be hand-held during the sharpening operation, along an industrial cutting line it may be preferred that the device be mounted at a cutting station in a position convenient to one utilizing the cutting tool. Accordingly, the base may be provided with mounting brackets or the like to appropriately secure it to the work station for convenient use.

It will be understood, of course, that while the form of the invention herein shown and described constitutes a preferred embodiment of the invention, it is not intended to illustrate all possible forms of the invention. It will also be understood that the words used are words of description rather than of limitation, and that various changes may be made without departing from the spirit and/or the scope of the invention herein disclosed.

What is claimed is:

1. Apparatus for providing a sharpened cutting edge on an elongated cutting tool comprising:

(a) a base, said base defining at least one elongated slot therein, said base including at least one support located adjacent said slot, said support defining a first upper ledge at a predetermined angle with respect to said slot;

(b) an elongated straight sharpening element residing atop said angular ledge and extending downwardly across said slot;

(c) means associated with said base and an upper end of said sharpening element to apply a predetermined pressure only on said sharpening element; and (d) stop means secured to said base on an opposite side of said slot to said support, a portion of said sharpening element freely engaging an underside of said stop, so that a cutting tool being moved along said slot with the edge of same in contact with said sharpening element will be sharpened by said sharpening element with said sharpening element pivoting downwardly about said ledge when pressure of said edge thereagainst exceeds said predetermined pressure to avoid excess pressure of said edge against said element.

2. Apparatus as defined in claim 1, wherein said elongated slot has a width just adequate to permit free passage of a cutting tool therealong.

3. Apparatus as defined in claim 1, wherein said base comprises a rear support and a front support spaced apart therefrom, at least one of said front and rear supports defining said elongated slot, said sharpening element being located between said front and rear supports.

4. Apparatus as defined in claim 1 wherein said means for applying pressure on said sharpening element is a spring means connected between said base and said element adjacent an upper end of same.

5. Apparatus as defined in claim 1 wherein said base defines a second angular support ledge located on an opposite side of said slot to said first support ledge, the angle of said second support ledge being opposite to the angle of said first support ledge and further comprising a second elongated straight sharpening element received atop said second ledge and extending across said slot, said first and second sharpening elements intersecting at said slot; means associated with said base and an upper end of said second sharpening element to apply a predetermined pressure only on said second sharpening element; and second stop means secured to said base on an opposite side of said slot to said second ledge, a portion of said second sharpening element freely engaging an underside of said second stop means.

6. Apparatus as defined in claim 5 wherein said sharpening elements are straight-steel members pivotally secured to said base, and further comprising means to impart spring tension to said sharpening elements.

7. Apparatus as defined in claim 5 wherein one of said sharpening elements is pivotally secured to one side of said base and the other of said sharpening elements is secured to an opposite side of said base.

8. Apparatus for providing a sharpened cutting edge on an elongated cutting tool, comprising:

(a) a base having an elongated slot therein;

(b) a pair of elongated sharpening elements, each of which is pivotally secured to said base adjacent one end of said slot at a pivot point adjacent the upper end of said elements, each of said elements having a curved portion on one side of said pivot point which curves downwardly; and (c) counterweight means disposed on the other end of each of said sharpening elements having a weight which is in excess of the weight of said curved portion and which applies a predetermined downward force on the other end of said elements to cause each of said elements to pivot about its pivot and across said slot, said elements intersecting with each other where they cross said slot so as to provide contact sharpening surfaces to each side of the cutting edge of said elongated cutting tool passing through said slot.

9. Sharpening apparatus as set forth in claim 8 wherein said elongated slot has a width adequate to permit free passage of a cutting tool therethrough, but narrow enough to maintain the axial orientation of said cutting tool relative to said sharpening elements.

10. Sharpening apparatus as set forth in claim 8 wherein said sharpening elements are curved so as to provide a substantially uniform angle of contact between the cutting edge surfaces and the sharpening elements throughout the length of said elongated slot.

11. Sharpening apparatus as set forth in claim 8 wherein each of said sharpening elements have the same amount of counterweight thereon.

12. Sharpening apparatus as set forth in claim 11 wherein said counterweights are selected so as to provide a predetermined resistance to the passage of the elongated cutting tool through the length of said elongated slot.

13. Sharpening apparatus as set forth in claim 8 wherein the edge of the cutting tool contacts the sharpening elements at the inside curved surface.

14. Sharpening apparatus as set forth in claim 8 wherein the edge of the cutting tool contacts the outside curve of the sharpening elements.

15. Sharpening apparatus as set forth in claim 8 wherein each of said sharpening elements are smooth.

16. Sharpening apparatus as set forth in claim 8 wherein each of said sharpening elements are made out of steel.

17. Sharpening apparatus as set forth in claim 8 wherein each of said sharpening elements has an abrasive surface.

18. Apparatus for providing a sharpened cutting edge on an elongated cutting tool, comprising:

(a) a non-metallic base having an elongated slot therein;

(b) a first pair of elongated sharpening elements, each of which is pivotally secured to one side of said base adjacent to one end of said slot, on one side of said slot and has one end which extends downwardly;

(c) means connected to the other end of each of said first pair of elongated sharpening elements to apply a predetermined downward force to the other end of said elements to cause said elements to pivot about their pivots and across said slot, said elements also intersecting with each other so as to provide contact sharpening surfaces to each side of the cutting edge of an elongated cutting tool passing through said slot; and (d) a second pair of sharpening elements disposed on the reverse side of said base, which have curved surfaces which extend over a portion of said elongated slot into abutting contact with each other.

* * * * *